US008893823B2

(12) United States Patent
Bui et al.

(10) Patent No.: US 8,893,823 B2
(45) **Date of Patent: *Nov. 25, 2014**

(54) METHODS AND APPARATUS FOR DRILLING DIRECTIONAL WELLS BY PERCUSSION METHOD

(75) Inventors: Huy D. Bui, Houston, TX (US); Brooks Howard Javins, Morgantown, WV (US)

(73) Assignee: Javins Corporation, Morgantown, WV (US)

( * ) Notice: Subject to any disclaimer, the term of this patent is extended or adjusted under 35 U.S.C. 154(b) by 517 days.

This patent is subject to a terminal disclaimer.

(21) Appl. No.: 12/946,672

(22) Filed: Nov. 15, 2010

(65) Prior Publication Data

US 2011/0061936 A1 Mar. 17, 2011

Related U.S. Application Data

(63) Continuation-in-part of application No. 12/028,403, filed on Feb. 8, 2008, now Pat. No. 7,832,502.

(51) Int. Cl.

| | |
|---|---|
| ***E21B 7/00*** | (2006.01) |
| ***E21B 4/10*** | (2006.01) |
| ***E21B 4/14*** | (2006.01) |
| ***E21B 4/00*** | (2006.01) |
| ***E21B 4/06*** | (2006.01) |

(52) U.S. Cl.

CPC . *E21B 4/006* (2013.01); *E21B 4/14* (2013.01); *E21B 4/06* (2013.01)

USPC ..... 175/61; 175/296; 175/322; 175/92

(58) Field of Classification Search

USPC ..... 175/92, 57, 61, 298; 173/93.6, 93.5, 17, 173/104

See application file for complete search history.

(56) References Cited

U.S. PATENT DOCUMENTS

| | | | | |
|---|---|---|---|---|
| 1,845,074 | A * | 2/1932 | Billstrom | 175/298 |
| 5,305,837 | A * | 4/1994 | Johns et al. | 175/61 |
| 5,322,136 | A | 6/1994 | Bui et al. | |
| 5,350,025 | A | 9/1994 | Campbell et al. | |
| 5,735,358 | A * | 4/1998 | Lyon | 175/96 |

(Continued)

FOREIGN PATENT DOCUMENTS

| | | |
|---|---|---|
| WO | WO 95/04207 | 2/1995 |

OTHER PUBLICATIONS

Australian Examination Report for Application No. 2009212252 dated May 3, 2011.

(Continued)

*Primary Examiner* — James Sayre

(74) *Attorney, Agent, or Firm* — Patterson & Sheridan, LLP

(57) ABSTRACT

A drilling tool assembly may include a housing, a piston disposed in the housing, and a clutch assembly coupled to the housing and the piston. The clutch assembly may be configured to facilitate rotation of the piston relative to the housing. A cutting assembly may be coupled to the piston in a manner that it is rotatable relative to the piston. A method of forming a wellbore may include positioning a drilling tool in the wellbore, the drilling tool comprising a housing, a piston, a clutch assembly, and a drill head. The method may further include reciprocating the piston axially within the housing, rotating the piston relative to the housing the clutch assembly, rotating the drill head relative to the housing and the piston, and forming the wellbore.

32 Claims, 12 Drawing Sheets

(56) References Cited

U.S. PATENT DOCUMENTS

| | | | | |
|---|---|---|---|---|
| RE36,166 | E * | 3/1999 | Johns et al. | 175/61 |
| RE36,848 | E | 9/2000 | Bui et al. | |
| 6,609,577 | B2 * | 8/2003 | Beccu | 173/93.6 |
| 6,799,646 | B1 | 10/2004 | Daigle et al. | |
| 6,962,213 | B2 | 11/2005 | Hartwick | |
| 7,832,502 | B2 * | 11/2010 | Bui et al. | 175/61 |
| 2002/0185312 | A1 | 12/2002 | Armell et al. | |
| 2004/0089461 | A1 * | 5/2004 | Cioceanu | 173/90 |

OTHER PUBLICATIONS

Canadian Office Action for Application No. 2,715,249 dated Mar. 29, 2012.

* cited by examiner

METHODS AND APPARATUS FOR DRILLING DIRECTIONAL WELLS BY PERCUSSION METHOD

CROSS-REFERENCE TO RELATED APPLICATIONS

This application is a continuation-in-part of U.S. patent application Ser. No. 12/028,403, filed Feb. 8, 2008 now U.S. Pat. No. 7,832,502, which is herein incorporated by reference in its entirety.

BACKGROUND OF THE INVENTION

1. Field of the Invention

Embodiments of the present invention generally relate to methods and apparatus for impact drilling. Particularly, embodiments of the present invention relate to a drilling tool that impacts while simultaneously rotating a drill head, independent from the rotation of the drill string.

2. Description of the Related Art

A percussion method of drilling a well bore into an earthen formation, especially hard rock, involves a cyclic and spike-like impacting force rather than a steady pressing force imposed by the weight of the drill string. This percussive action produces a superior high rate of penetration versus the traditional drill-by-weight method.

By employing a percussion drilling tool, the drill head needs to be rotated so that the cutting elements mounted on its face come to contact with fresh rock formations during each subsequent strikes. Traditionally, this need is achieved by keying the drill head to the drill string so that the rotation of the drill string, provided by a rotary table mounted on the rig, and in the range of 20 to 40 rpm, is transferred to the drill head.

The percussion drilling tools are pneumatic devices connected to the end of a drill string. Highly compressed air is directed alternately into and out of two separate chambers. One chamber is positioned above a sliding body, commonly known as a piston, and the other chamber is positioned below the sliding body so that the air causes the body to accelerate up and down, reciprocating within the tool housing. During the tool operation, the drill head is kept in contact with the earth at the bottom of a well bore. As the sliding body is directed downward, it forcefully strikes the top of the drill head and causes the rock contacting the drill head to disintegrate. As stated above, it is desired to rotate the drill head to allow it to penetrate fresh rock during subsequent strikes from the sliding body. Although percussion drilling tools may afford faster penetration rates, the need to rotate the entire drill string takes away the ability to deviate the well bore trajectory in the desired direction.

To apply the requisite striking force that will break the rock formation, the reciprocating piston travels at a relatively high linear velocity, in the range of 300 to 400 inches per second. In methods that employ the kinetic energy of the axial motion of the piston to induce a rotational motion on the drill head, high velocity motion between contacting bodies may be involved. Moreover, torques of high magnitudes, in the range of 500 to 1,000 foot pounds under ideal conditions, and up to 3,000-4,000 foot pounds under adverse conditions, are required to rotate the drill head against frictional forces imposed by the formation and inevitably cause high contact stress at the surfaces adjacent to the piston and drill head. The combined effect of high contact velocity and high contact stress generates a great deal of friction and heat, resulting in severe galling damage at these contact surfaces.

In conventional drill-by weight method, the force that is used to press the drill head against the bottom of the formation, commonly called weight-on-bit, is typically between 20,000 to 50,000 pounds. In percussion drilling, since it is the impact force of the reciprocating piston against the drill head that breaks up the formation, this immense weight-on-bit is not needed. However, as the tool penetrates the formation, the drill head tends to slide out of the housing of the tool. If the drill string is not allowed to keep up with the drill head progression into the formation, the tool can enter into an "opening position" and stop cycling. Therefore, it is dependent on the skill of the operator to advance the drill string into the well bore quick enough to prevent the tool from opening.

On the contrary, however, if the weight of the drill string is not held back properly, the drill string can apply excessive weight onto the drill head. This is also undesirable since the extreme weight-on-bit dramatically increases the frictional torque necessary to rotate the drill head. The operator thus faces the difficult task of advancing the drill string, on the one hand, quick enough to prevent the tool from opening, and on the other, slow enough to avoid pressing the drill head too hard against the formation. The operator must hold back most of the drill string weight, yet strives to allow just enough force to keep the tool closed. Frictional drag created by contact between the drill string and the walls of the well bore exacerbates this dilemma.

Therefore, there is a need for a percussion drilling tool capable of rotating the drill head independently from the drill string, without the detrimental galling effects caused by motion under high contact stress at high velocity. There is also a need for providing a means with which the driller can rely on to advance the drill string into the well bore without pressing the drill head neither too hard nor too lightly against the formation.

SUMMARY OF THE INVENTION

The present invention generally relates to methods and apparatus for drilling. In one aspect, a drilling tool assembly is provided. The drilling tool assembly includes a cylindrical housing. The drilling tool further includes a piston axially movable within the housing. The drilling tool also includes a rolling key assembly disposed between the housing and the piston. The rolling key assembly comprises a bearing adapted to roll during a first direction of the piston and slide during a second direction of the piston. Additionally, the drilling tool includes a cutting assembly operatively attached to the piston, wherein the cutting assembly is configured to rotate relative to the piston as the piston moves axially within the housing.

In another aspect, a drilling tool assembly is provided. The drilling tool assembly includes a body and a piston axially movable along the body in a first direction and a second direction. The drilling tool assembly further includes a drill head. Additionally, the drilling tool assembly includes a clutch mechanism operatively attached to the piston and the drill head, wherein the clutch mechanism is configured to rotate the drill head relative to the piston as the piston moves in the first direction.

In yet a further aspect, a method of forming a well bore is provided. The method includes the step of positioning a drilling tool in the well bore on a drill string. The drilling tool comprises a body, a piston, a clutch mechanism, and a drill head. The method further includes the step of reciprocating the piston axially by alternately directing compressed air to an upper chamber above the piston and a lower chamber below the piston. The method even further includes the step of rotating the drill head independently of the drill string, wherein the drill head is configured to rotate as the piston moves axially along the body and engages the clutch mechanism, and wherein the drill head rotates relative to the piston. Additionally, the method includes the step of applying an impact force as the drill head rotates, thereby forming the well bore.

A drilling tool assembly may comprise a housing; a piston disposed in the housing; a clutch assembly coupled to the housing and the piston, wherein the clutch assembly is configured to facilitate rotation of the piston relative to the housing; and a cutting assembly coupled to the piston, wherein the cutting assembly is rotatable relative to the piston.

A drilling tool assembly may comprise a housing, a piston, a clutch assembly, a drive shaft, and a cutting assembly. The piston may be axially movable within the housing. The clutch assembly may be disposed between the housing and the piston so that the clutch assembly forces rotation of the piston relative to the housing while the piston moves in a first direction. The drive shaft may be coupled to the piston, and the cutting assembly may be coupled to the drive shaft. The cutting assembly rotates relative to the piston as the piston moves in the first direction.

A method of forming a wellbore may comprise positioning a drilling tool in the wellbore using a work string, the drilling tool comprising a housing, a piston, a clutch assembly, and a drill head. The method may include reciprocating the piston axially within the housing by alternately directing pressurized fluid to an upper chamber above the piston and a lower chamber below the piston; rotating the piston relative to the housing the clutch assembly; rotating the drill head relative to the housing and the piston; and applying an impact force to the drill head to form the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to an apparatus and method of rotating a well bore tool. As set forth herein, the invention will be described as it relates to a percussion drilling tool. It is to be noted, however, that aspects of the present invention are not limited to a percussion drilling tool, but are equally applicable to other types of well bore tools. To better understand the novelty of the apparatus of the present invention and the methods of use thereof, reference is hereafter made to the accompanying drawings.

Figure 1:
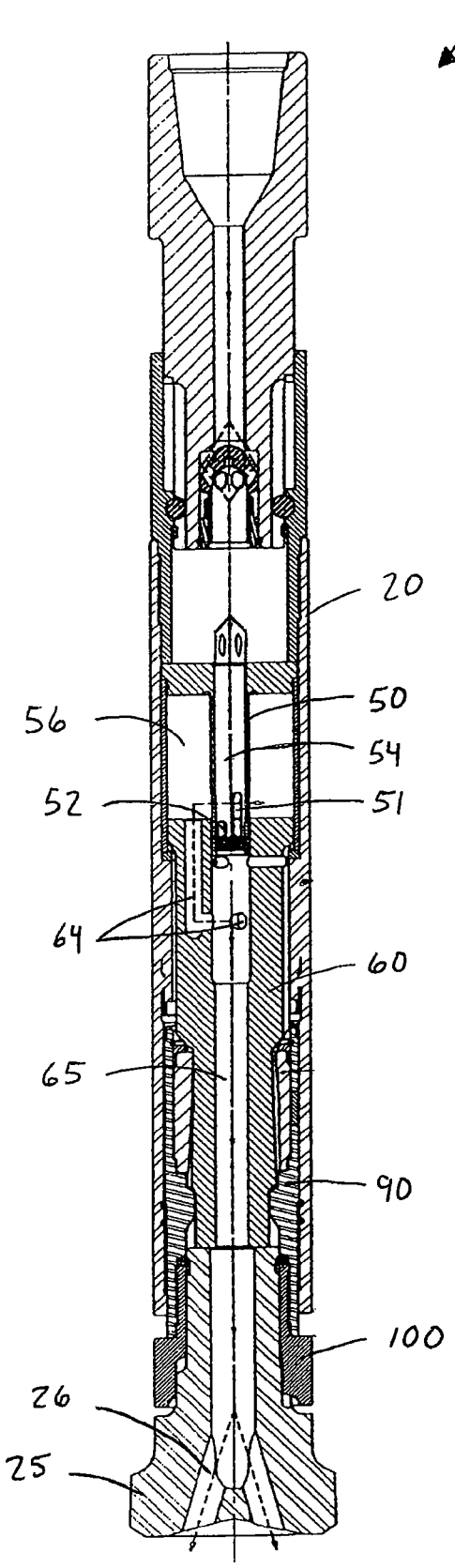
FIG. 1 is a sectional view of the drilling tool in flushing mode.
Figure 2:
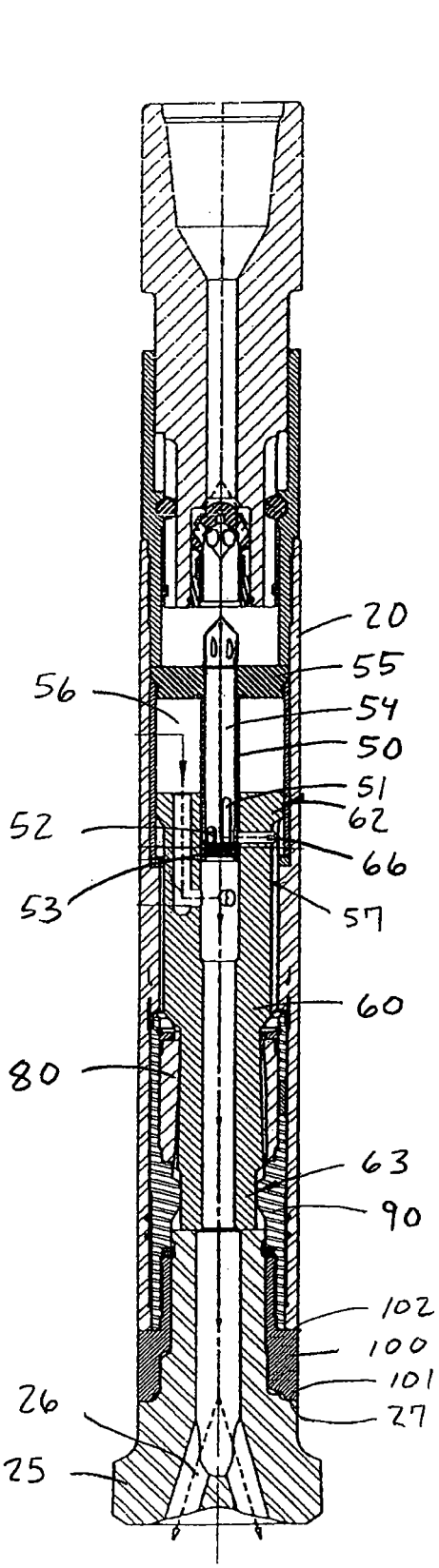
FIG. 2 is a sectional view of the drilling tool at the beginning of the upstroke of the piston.
Figure 3:
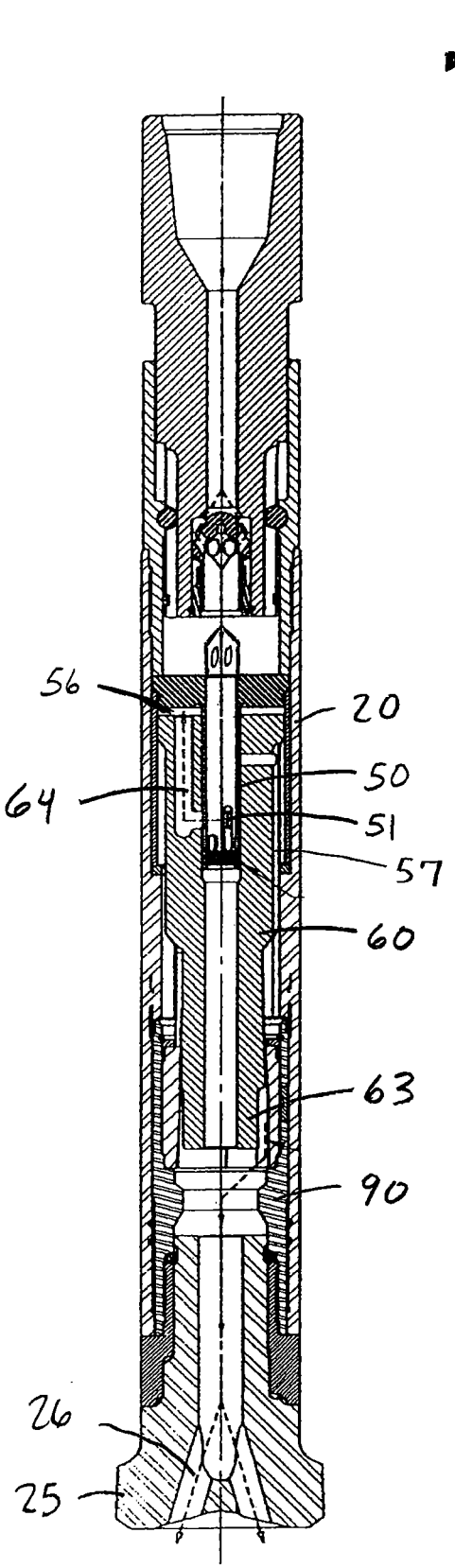
FIG. 3 is a sectional view of the drilling tool at the beginning of the down stroke of the piston.

FIGS. 1-3 will be briefly discussed to provide a general overview of the operation of a percussion drilling tool and a method of percussion drilling. As a percussion drilling tool is hung off bottom in a well bore by a drill string, pressurized air is directed down the drill string through and by-passing the tool into the well bore. This is known as a "flushing" mode, and it helps remove rock chips and other debris at the bottom of the rock formation. When the tool lands at the bottom of the well bore, a drill head is positioned into a "closed" mode and operation of the tool begins. During operation, a piston body begins to reciprocate within the tool housing and impacts the top of the drill head, fragmenting the adjacent rock formation below the drill head. The drill head is rotated independent of the drill string by a mechanism described later, so that the cutting elements on the drill head strike fresh rock during subsequent impacts. For example, the drill head may be rotated 6 to 7 degrees per cycle of the piston, so that the cutting elements on the perimeter of the drill head displace a distance of about half of their diameters.

FIG. 1 shows the "flushing" mode of a drilling tool 10, as the tool is hung off bottom. A cutting assembly 25, one example of which will be referred to herein as a drill head 25, is suspended from a retaining sleeve 100, and both are partially disposed within a body or housing 20 and may be attached to a drive shaft 90. The drive shaft 90 is rotatable relative to the housing 20. Prior to landing the drill head 25 against the bottom of the well bore, pressurized air may be directed down the drill string and into a feed tube chamber 54. The air may then be directed through opening 51 into an upper chamber 56 and from there to an internal piston chamber 65 via channel 64. From the chamber 65 internal of a piston 60, the air may be directed out through openings 26 formed in the drill head 25. The pressurized air helps remove any debris that accumulates near the bottom of the well bore. Finally, the gap between the lower end of the housing 20 and the retaining sleeve 100 is called the "hammer drop," and the gap between the lower end of the retaining sleeve 100 and the drill head 25 is called the "bit drop." Both of these gaps are open during the flushing mode operation of the tool.

FIG. 2 shows the "closed" mode of the drilling tool 10 after it is lowered down the well bore and the drill head 25 contacts the bottom of the well. At this point, the "hammer drop" and "bit drop" are closed. Specifically, the drill head 25 and the retaining sleeve 100 are pushed into the housing 20 until a shoulder 27 formed by the drill head contacts a first shoulder 101 of the retaining sleeve 100 and a second shoulder 102 of the retaining sleeve 100 contacts the end of the housing 20. Upon contact, the piston 60 is pushed upward so that the air to the upper chamber 56 is shut off, as an upper section 62 of the piston 60 covers the opening 51 of a feed tube 50. The air, in turn, is redirected through opening 52 of the feed tube 50 into a lower chamber 57 via slot 66. A lower end 63 of the piston 60 engages with and seals against the bore of the drive shaft 90 so that as the lower chamber 57 is charged, the force of the built up pressure will accelerate the piston up the housing 20. This begins the reciprocation of the piston 60 and the operation of the drilling tool.

FIG. 3 shows the piston 60 at the top of its travel. As the piston 60 is accelerated upward, the sealed engagement between the lower end 63 of the piston 60 and the drive shaft 90 is released and the air from the lower chamber 57 is discharged through the openings 26 in the drill head 25. Thereafter, the pressurized air is then redirected from the opening 51 in the feed tube 50 to the upper chamber 56 via channel 64 to pressurize this chamber and decelerates the piston 60 until it comes to a stop then accelerates it downward so that the lower end 63 of the piston impacts the top of the drill head 25.

Such a drilling tool 10, together with a bend sub (not shown) placed above and near the drill head, may allow the driller to maintain the orientation of the bend in the desired direction, thus enabling the well bore to be drilled directionally and percussively. The drilling tool 10 may achieve a build rate, or dog leg severity, of 5 degrees to 15 degrees per 100 feet in conjunction with bend subs of ½ degree to 2 degrees bend angles.

Aside from this general operation, the drilling tool 10 includes a rolling key assembly that may be employed to address issues relating to the detrimental galling effects caused by high surface contact stresses and high velocity motion of the reciprocating piston. In addition, the drilling tool 10 includes a clutch mechanism with high respond frequency that may be employed to induce rotational motion onto the drill head.

To begin, let's focus on the galling issue. As described later, the drill head 25 rotates independent of the drill string as the result of the rotation of the drive shaft 90, which is driven by the reciprocating piston 60 via an oscillating clutch 80. The piston 60 is slideably engaged within the cylinder housing 20 so that it may move axially within the housing but may not rotate with respect to the housing. Since the reciprocating piston 60 provides the high force necessary to rotate the drill head, high compressive stresses under high velocity are produced on the piston and adjacent contacting surfaces. To avoid damages caused by severe sliding friction and extreme contact shear stress, a "rolling" action may be employed at these surfaces.

Figure 4:
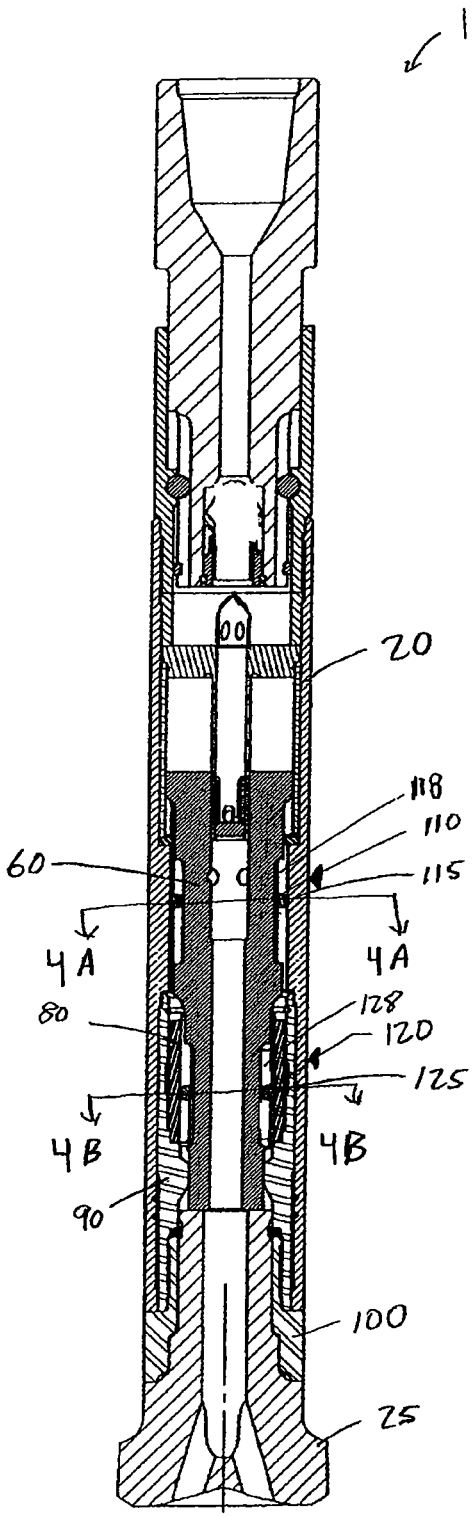
FIG. 4 is a sectional view of a first rolling key assembly and a second rolling key assembly.

FIG. 4 illustrates a first rolling key assembly 110 and a second rolling key assembly 120 that may be utilized to alleviate such stresses. One or more of these rolling key assemblies may be used during the operation of the drilling tool.

Figure 4A:
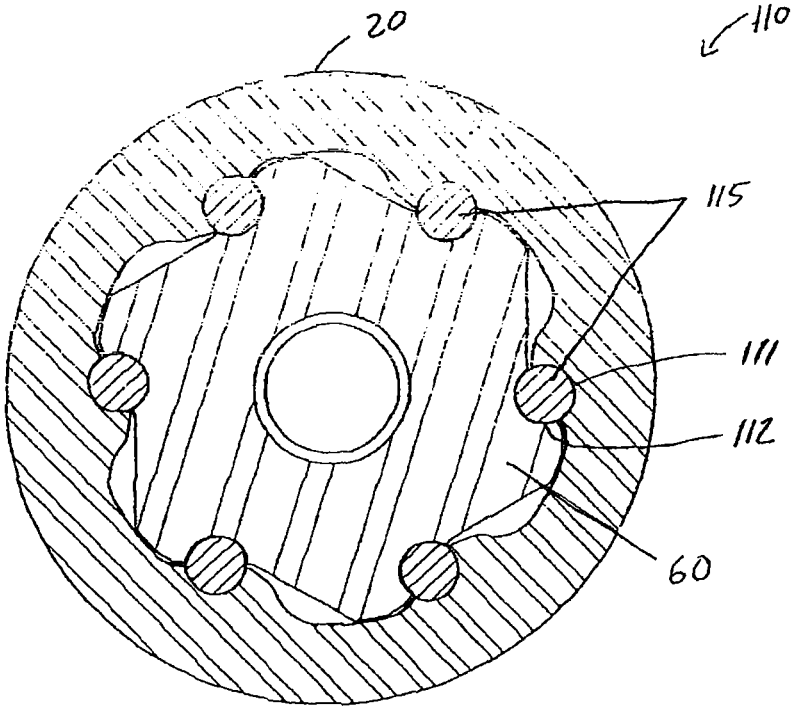
FIG. 4A is a cross sectional view of one embodiment of the first rolling key assembly.

Referring to the first rolling key assembly 110, in one embodiment, the piston 60 may move axially with respect to the housing 20, but may not rotate relative to the housing. To prevent rotation of the piston 60, a set of grooves 111 (shown in FIG. 4A) are machined on the outer surface of the piston, and a similar matching set of grooves 112 (shown in FIG. 4A) are machined on the inner surface of the housing 20. The sets of grooves may be formed in a straight configuration. The two sets of grooves 111, 112 form a set of bearing races 118 which host one or more bearing 115, one example of which referred to herein is a rolling key 115. The bearing may include a spherical member. These grooves may have spherical ends that limit the movement of the rolling key within each race. As the piston 60 reciprocates axially within the housing 20, the rolling key 115 disposed between the grooves prevents rotational movement of the piston relative to the housing. In addition, the rolling key 115 may reduce the frictional stresses created by the reciprocating piston 60 by affording a rolling action between the piston 60 and the housing 20.

To ensure that the key rolls during a stroke of the piston 60, the key is positioned in the race so that there is enough length of race for it to roll before it hits the end of the race. For example, if the piston moves axially a distance of X with respect to the housing, the key rolls a distance of X÷2 with respect to the piston, as well as a distance of X÷2 with respect to the housing. When the piston is at its uppermost position, the upper end of the groove on the piston should be at least a distance of X÷2 above the upper end of the groove on the housing, and the distance from the lower end of the groove on the piston to the lower end of the groove on the housing should be at least X÷2. In such an arrangement, as the piston moves down a distance of X, the key has a raceway at least X÷2 long to roll on the piston and on the housing respectively. In addition, when the piston is at its lowest position, i.e., at impact, the distance from the lower end of the groove on the piston to the upper end of the groove on the housing should be at least equal to X to ensure that the piston does not strike the key against the upper end of the groove on the housing.

In one embodiment, the piston 60 is configured to rotate the drill head in the down stroke. As the piston 60 moves upward a distance of X, the key may roll if it contacts the groove surfaces or may not roll if it does not. In any case, the lower end of the piston groove would catch up with the key and carry it up the housing groove and position it in a location at least X÷2 distance from the upper end of the piston groove and at least X÷2 distance from the lower end of the housing groove, suitable for its complete rolling action when the piston moves downward.

In the other direction, as the piston 60 moves downward a distance X, and as it applies the necessary torque to rotate the drill head, the reactive torque, of equal value and in opposite direction to that of the high torque required to rotate the bit, causes the surface on the piston groove to press the key hard against the surface of the housing groove. As a result, the key rolls a distance of X÷2 on the piston groove and a distance of X÷2 on the housing groove. Thus, rolling instead of sliding action is ensured and galling on these surfaces is avoided.

In an alternative embodiment, the piston 60 is configured to rotate the drill head in the upstroke. As the piston 60 moves downward a distance of X, the key may roll if it contacts the groove surfaces or may not roll if it does not. In any case, the upper end of the piston groove would catch up with the key and carry it down the housing groove and position it in a location at least X÷2 distance from the lower end of the piston groove and at least X÷2 distance from the upper end of the housing groove, suitable for its complete rolling action when the piston moves upward.

In the other direction, as the piston 60 moves upward a distance X, and as it applies the necessary torque to rotate the drill head, the reactive torque, of equal value and in opposite direction to that of the high torque required to rotate the head, causes the surface on the piston groove to press the key hard against the surface of the housing groove. As a result, the key rolls a distance of X÷2 on the piston groove and a distance of X÷2 on the housing groove. Thus, rolling instead of sliding action is ensured and galling on these surfaces is avoided.

FIG. 4 also shows a second rolling key assembly 120. The second rolling key assembly 120 is positioned between the clutch 80 and the piston 60, and it includes one or more bearings 125, one example of which referred to herein are rolling keys 125, and one or more races 128. The races may be formed in a helical configuration. The rolling keys 125 help facilitate the rolling action between the surfaces of the races on the clutch 80 and the piston 60, which may lessen the amount of fictional drag and contact shear stresses generated by the travel of the two mating components. It is important to note that the same embodiments and examples described above with respect to the first rolling key assembly 110 are equally applicable to the second rolling key assembly 120 and vice versa.

Figure 4B:
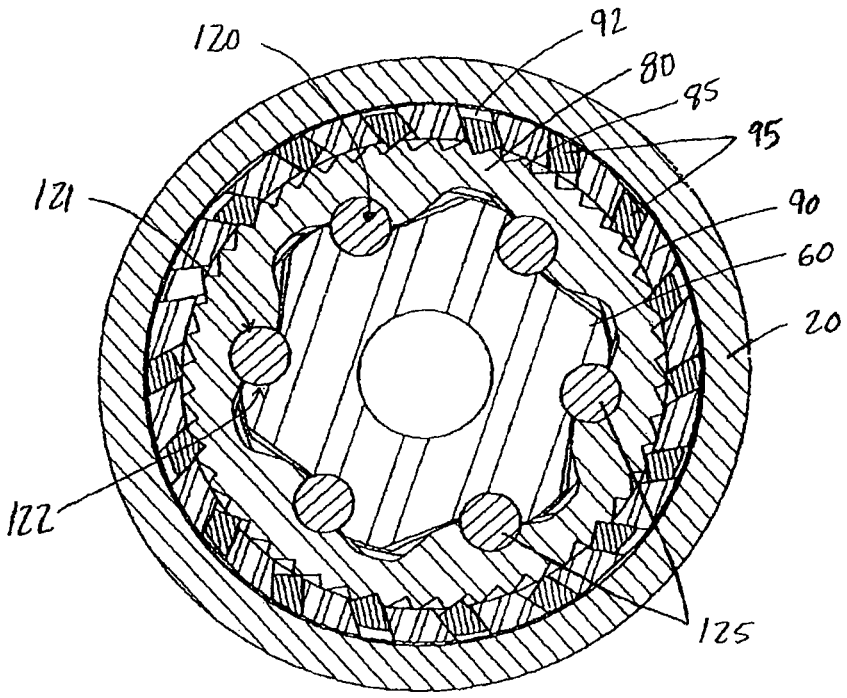
FIG. 4B is a cross sectional view of one embodiment of the second rolling key assembly and the clutch mechanism.

FIG. 4B shows a cross section of the second rolling key assembly 120. Let's now focus on the clutch mechanism. The piston 60 reciprocates axially within the housing 20 and may not rotate with respect to the housing. However, the clutch 80 is forced to rotate, since it engages the piston 60 through a set of helical grooves 121 machined on the outer surface of the piston, a similar matching set of grooves 122 machined on the inner surface of the clutch 80, and a set of rolling keys 125 disposed between the grooves. As the piston 60 reciprocates axially within the housing, it forces the clutch 80 to oscillate in a clockwise and counterclockwise direction by the travel of the rolling keys 125 along the helical raceways. For example, if the helical grooves are machined in a counterclockwise manner from the upper end of the groove to the lower end of the groove, as the piston moves down the clutch will oscillate in a clockwise direction, and as the piston move up the clutch will oscillate in a counter clockwise direction.

Further, the one-way clutch 80 is adapted to engage the drive shaft 90 and transfer the motion in one direction of its oscillating motion to the drill head 25, either clockwise or counterclockwise. This allows the drill head 25 to be rotated in a stepping motion, either clockwise or counterclockwise. When the clutch 80 engages the drive shaft 90, the contact stresses between the piston 60 and its adjacent surfaces are at their highest. Therefore, the second rolling key assembly 120 should be configured to provide a continuous rolling action during the stroke of the piston when the clutch engages the drive shaft 90, as described with respect to the first rolling key assembly 110. Specifically, the key should be positioned in the race where there is enough length of race for it to roll through the entire stroke of the piston 60 before it hits the end of the race. Upon the return stroke of the piston 60, when the clutch disengages, and the contact stress is minimal since it does not try to rotate the bit, the rolling key 125 may roll and/or be carried by the end of the groove on the piston 60 to a position where it will have ample race to roll on when the clutch engages during the piston's next stroke.

In one embodiment, the helical grooves are machined on the piston and the clutch so that as the piston reciprocates with no angular displacement, the clutch oscillates in a clockwise direction as the piston is stroked downward, and the clutch oscillates in a counterclockwise direction as the piston is stroked upward.

In an alternative embodiment, the helical grooves are machined on the piston and the clutch so that the clutch oscillates in a counterclockwise direction as the piston is stroked downward, and the clutch oscillates in a clockwise direction as the piston is stroked upward.

In an alternative embodiment, the rotation of the drill head 25 may be produced from rotation of the piston 60 and rotation of the clutch 80. In this embodiment, the races 118 of the first rolling key assembly 110 may be configured to provide X degrees of rotation of the piston relative to the drill string; and the races 128 of the second rolling key assembly 120 may be configured to provide Y degrees of rotation of the clutch 80 relative to the piston itself. The races 118, 128 on either the first or second rolling key assemblies 110, 120 may include a constant angle helix, a varying angle helix, or combinations thereof. The total angular displacement of the drill head 25 per cycle of the piston 60 may be provided by the configurations of the races 118, 128 of the first and second rolling key assemblies 110, 120. For example, the configuration of the races 118 of the first rolling key assembly 110 may provide an X degree angular displacement of the drill head 25 and the configuration of the races 128 of the second rolling key assembly 120 may provide a Y degree angular displacement of the drill head 25, for a total angular displacement of the drill head 25 equal to X plus Y degrees.

As stated above, the drill head 25 of the drilling tool rotates independent of the drill string through a clutch mechanism that is driven by the piston 60. FIG. 4 illustrates the clutch 80 and the drive shaft 90. The clutch 80 is releasably coupled to the drive shaft 90 so that it may rotate the shaft in a single direction. Since the drive shaft 90 is connected to the retaining sleeve 100, which embraces the drill head 25, as the shaft rotates, the drill head moves rotationally with the shaft.

In an alternative embodiment, the drive shaft 90 may be either integral to or rigidly attached to the drill head 25.

Depending on the desired direction of rotation, when the piston 60 is stroked in one direction, the clutch 80 engages and rotates the drive shaft 90, which in turn rotates the drill head 25. When the piston 60 is stroked in the opposite direction, the clutch 80 disengages from the drive shaft 90, preventing the drill head 25 from rotating back in the opposite direction. Therefore, the drill head 25 is rotated in a clockwise or a counterclockwise stepping manner, independent from the drill string.

FIG. 4B also shows a cross section of the clutch 80 and the drive shaft 90. The clutch 80 is disposed within the drive shaft 90 and includes a multitude of notches 85 along its perimeter. The clutch 80 may rotate relative to the drive shaft 90, but may not move axially with respect to the drive shaft. Similarly, the drive shaft 90 includes a multitude of slots 92 that extend through the body of the drive shaft, and a multitude of dogs 95 that are housed within the slots and which can slide within the slots.

Pressurized air is allowed to enter the outer surface of the drive shaft 90 and applies a radially inward force on the dogs 95, causing them to be inwardly biased. The notches 85 on the perimeter of the clutch 80 are oriented in a manner to engage with the dogs as it is rotated in one direction. As shown in FIG. 4B, when the clutch 80 rotates counterclockwise, the clutch pushes the dogs 95 radially outward, allowing the clutch to slip with respect to the drive shaft 90. On the other hand, when the clutch 80 rotates clockwise, the notches 85 apply a tangential force on the engaged dogs 95 and impart rotation on the drive shaft 90. This configuration allows the clutch to switch from engagement to disengagement positions at a high respond frequency. For example, if the piston cycles at a frequency of 20 to 30 hertz, the clutch should be able to switch from engaging to disengaging positions 20 to 30 times per second.

In an alternative embodiment, the notches on the clutch are oriented to engage with the dogs when the clutch is rotated in a counterclockwise manner and disengage with dogs when it is rotated in a clockwise manner.

In one embodiment, the clutch 80 has a resolution R, i.e., a maximum angle that it may freely oscillate between two engaging positions. This resolution is to be set at slightly less than the angular displacement per cycle of the helical races on the piston to allow time for the dogs to slide in and engage the clutch. For example, if the angular displacement per cycle of the helical races on the piston is 6 or 12 degrees, depending on the aggressiveness of the helixes, the resolution on the clutch should be 5 or 10 degrees. A number of X notches are machined and equally spaced on the perimeter of the clutch 80. To have a resolution of 10 degrees, the clutch should have 36 notches, and to have a resolution of 5 degrees, the clutch should have 72 notches. Any value of X notches between 36 and 72 would yield a resolution equal to 360÷X, or between 5 and 10 degrees.

Generally, each notch in an arrangement as mentioned above may have a corresponding dog that it engages with during the engaging oscillation. However, as noted above, to have an angular rotation of 5 degrees, the drive shaft should have 72 slots through its body. The drive shaft may not be able to encompass so many slots of sufficient width. Therefore, in an alternative embodiment, the clutch resolution may be refined by mismatching the number of dogs and notches so that not all of the notches engage each of the dogs during each oscillation of the clutch. This feature also decreases the amount of wear the dogs and clutch incur for a given amount of cycles.

For example, the number of X notches on the clutch and the number of Y dogs/slots on the drive shaft are mismatched in such a way that Y is less than X and that they satisfy the following equation: k=Y÷(X minus Y), where k is an integer. If we assume Y=24 and X=36, then k=24÷(36−24)=2. The equally spacing angle between the dogs Y is 360÷24=15 degrees, and the angle between the notches X is 360÷36=10 degrees. Therefore, the resolution R of the clutch is now calculated as 15 degrees minus 10 degrees=5 degrees. This resolution R can be directly calculated from the values of the number of notches and dogs by the following equation: R=360 times (X minus Y)÷(X times Y). With the value of n=X minus Y representing the number of dogs engaged simultaneously at any given time and the value of k=Y÷(X minus Y) representing the number of sets of dogs that take turns to engage, one can design a clutch with the desired resolution and with the desired number of dogs engaged during each cycle. For example, with the values of X=36 and Y=24 as in the above example, one would have 2 sets of dogs with 12 dogs in each set that engage at a given time, and a resolution R=5 degrees. In another example, with values of X=24 and Y=18, one would have 3 sets of dogs with 6 dogs in each set that engage at a given time, and a resolution of R=5 degrees.

Finally, an event regarding the switching point from charging the lower chamber to charging the upper chamber, or vice versa, is noteworthy. As the piston is moving upward, it passes through a point where compressed air ceases to enter the lower chamber and another point where compressed air begins to enter the upper chamber. As the piston is moving downward, it passes through a point where compressed air ceases to enter the upper chamber, and later, through another point where compressed air begins to enter the lower chamber. In between these two charging points, the piston travels through a "dead band," which is generally about a one inch length of travel where the air flow through the drill string is shut off from the tool and the pressurized air within the tool is isolated from all other internal chambers. This dead band helps to increase the efficiency of the tool by allowing it to consume less volume of air at a certain operating pressure. However, should the piston for some reason stop within this dead band, it may stay there since there is no flow of compressed air into either chamber to move it axially. When this occurs, cycling of the piston may not be resumed. To push the piston out of the dead band should it stop there, a small amount of leakage is allowed to continuously enter one of the chambers, which is enough to move the piston, but insignificant enough to diminish the efficiency of the tool.

Figure 5A:
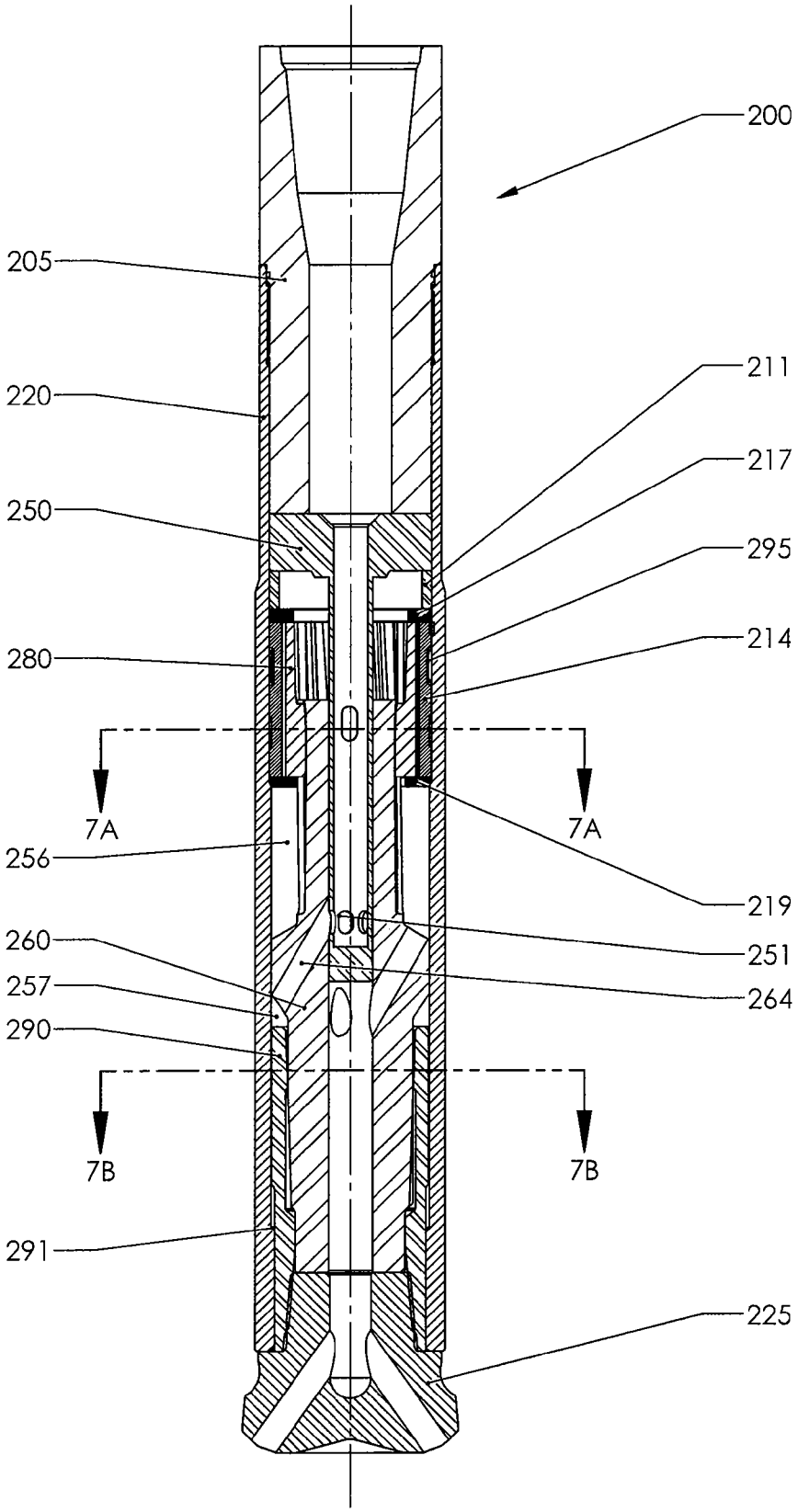
FIGS. 5A and 5B include a sectional view of the drilling tool according to one embodiment.
Figure 5B:
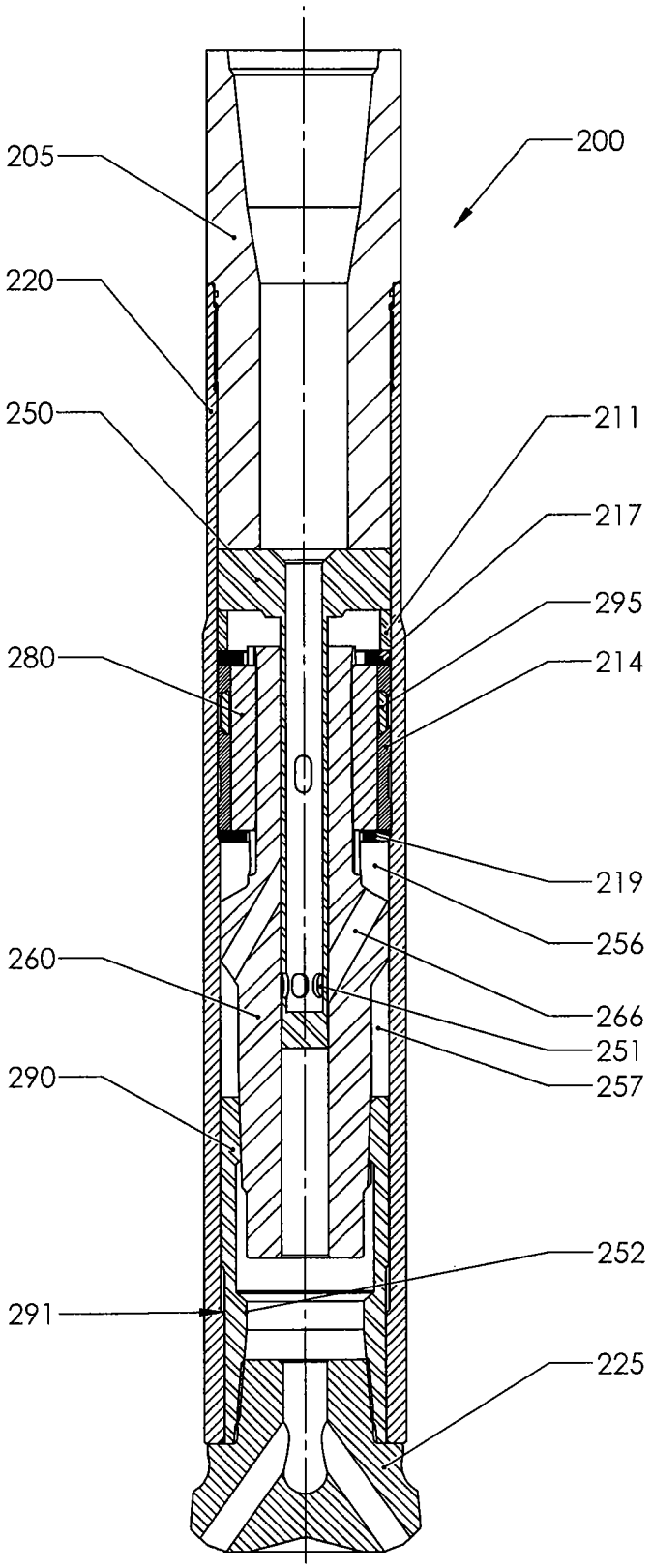

FIGS. 5A and 5B illustrate a drilling tool 200 according to one embodiment of the invention. The drilling tool 200 operates similar to the drilling tool 10, and the embodiments of the drilling tool 200 may be used with the drilling tool 10 and vice versa. Some of the components of the drilling tool 200 that are similar to the drilling tool 10 are identified with a "200" series reference numeral.

The drilling tool 200 includes a drill head 225 at one end of the tool, and a connection member 205 at the opposite end of the tool. The connection member 205 may include a bulkhead or other tubular member, and may be configured to connect the drilling tool 200 to a work string. Pressurized fluid may be supplied through a bore of the connection member 205 to operate the drilling tool 200. The connection member 205 may be threadedly connected to and partially disposed in an upper end of a housing 220 that supports and houses the remaining components of the drilling tool 200.

A feed tube 250 may be disposed within the housing 220 adjacent to and below the bottom end of the connection member 205, such that the bore of the connection member 205 is in fluid communication with a bore of the feed tube 250. An upper portion of the feed tube 250 may be spaced from a clutch 280 by a sleeve 211 or other tubular member. A lower portion of the feed tube 250 may extend through the clutch 280, and may be partially disposed through a piston 260, which is axially movable relative to the feed tube 250, the clutch 280, and the housing 220. Pressurized fluid may be supplied through one or more openings in the lower portion of the feed tube 250 and directed to upper and lower chambers 256 and 257 within the housing 220 via the piston 260. Depending on the position of the piston 260 relative to the openings along the axial length of the lower portion of the feed tube 250, pressurized fluid is supplied to one of the upper and lower chambers 256, 257, while the fluid pressure in the other one of the upper and lower chambers 256, 257 is released or exhausted.

As illustrated in FIG. 5A, one or more openings 251 in the feed tube 250 is in fluid communication with a first channel 264 (or bore) disposed through a middle portion of the piston 260 to direct pressurized fluid to the lower chamber 257. As the upper chamber 256 exhausts via a second channel 266 (or bore), pressurization of the lower chamber 257 will direct the piston 260 in an upward direction or toward the upper end of the drilling tool 200. As the piston 260 moves upward a certain distance, as illustrated in FIG. 5B, the opening 251 in the feed tube 250 is now in fluid communication with the second channel 266 disposed through the middle portion of the piston 260 to direct pressurized fluid to the upper chamber 256. At the same time, fluid in the lower chamber 257 is allowed to exhaust through a bore 252 of the drive shaft 290. Pressurization of the upper chamber 256 during this period will decelerate the upward motion of the piston 260 and eventually direct the piston 260 downward or toward the lower end of the drilling tool 200 until the piston impacts the drill head 225. In the manner, the piston 260 is alternately moved within the housing 220 and relative to the feed tube 250 to repeatedly impact the drill head 225 to conduct a drilling operation, such as to drill a wellbore.

As the piston 260 reciprocates within the housing 220, the clutch 280 facilitates rotation of the piston 260. In one embodiment, the clutch 280 may operate as a one-way positive engagement (PE) clutch. The motion of the piston 260 imparts rotation to a drive shaft 290 that is coupled to the drill head 225 such that rotation of the drive shaft 290 also rotates the drill head 225, and such that the piston 260 applies an impact force to the upper surface of the drill head 225. In one embodiment, to facilitate the flushing mode during which drilling fluid bypasses the drilling tool 200, similar to and as described in the operation of the drilling tool 10, the drive shaft 290 may be disposed in the housing 220 and may be allowed to slide a few inches out of the housing 220 until its outer diameter comes into contact with a shoulder 291 of the housing 220. In one embodiment, the drill head 225 may be threadedly connected to the inner surface of the drive shaft 290.

Figure 6:
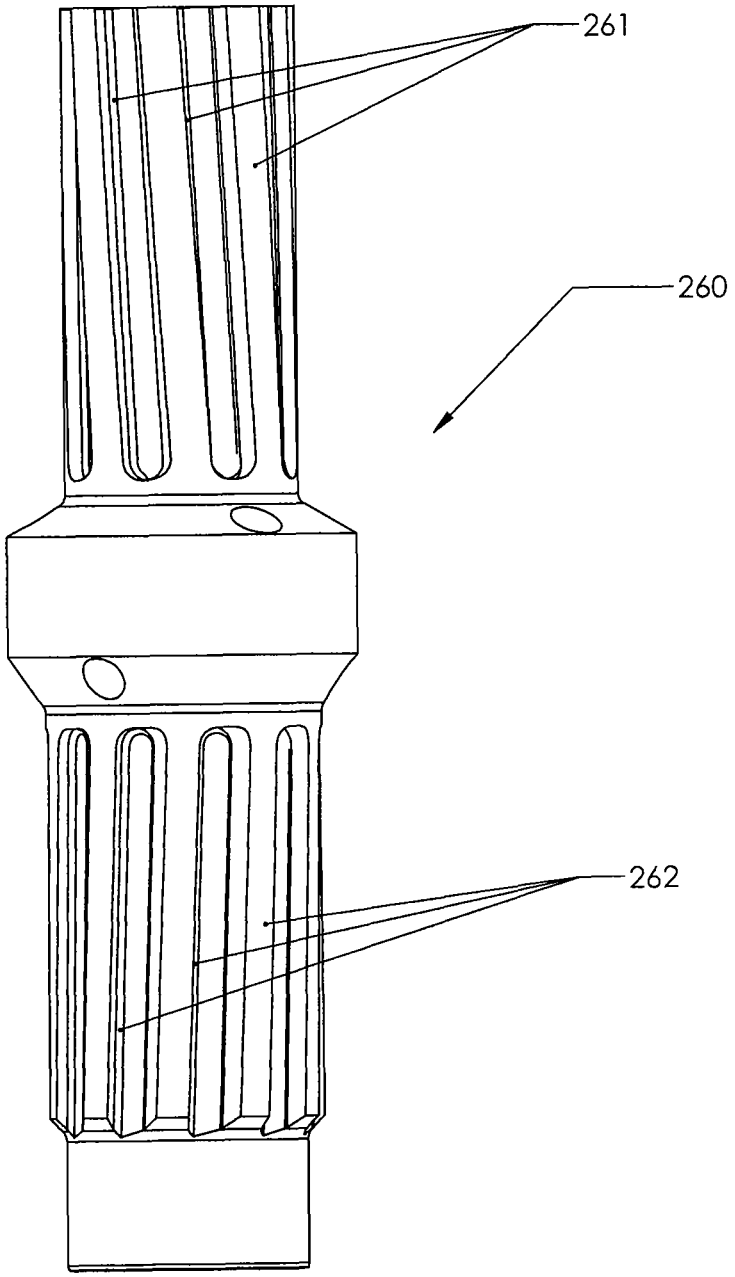
FIG. 6 illustrates a piston of the drilling tool according to one embodiment.
Figure 7A:
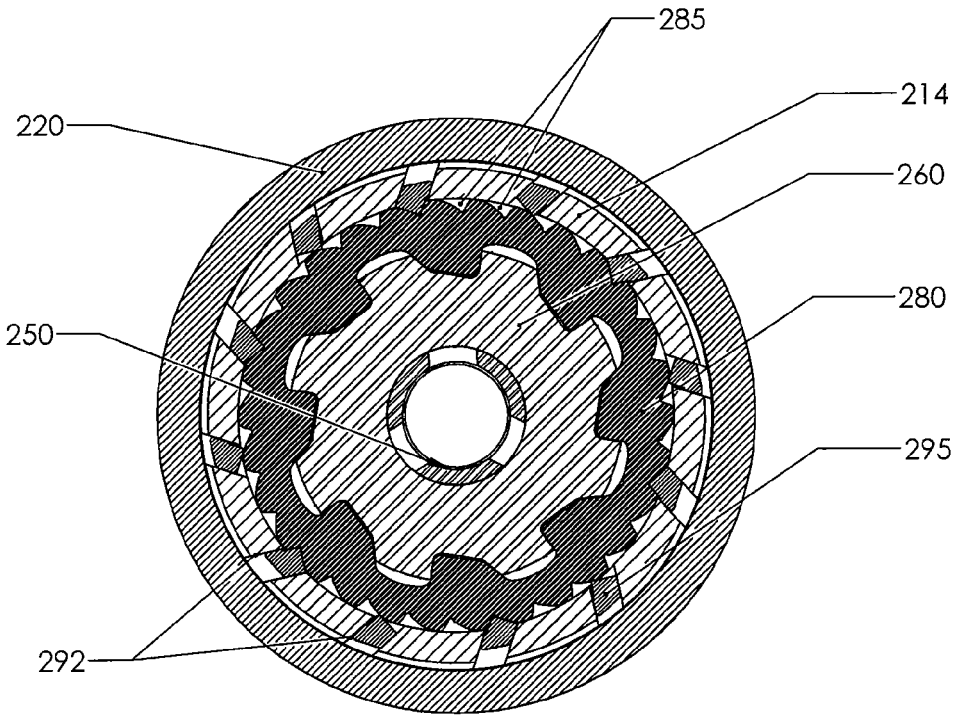
FIGS. 7A and 7B illustrate cross-sectional views of the drilling tool according to one embodiment.

FIG. 6 illustrates the piston 260 according to one embodiment. The upper section of the piston 260 has one or more helical grooves 261, such as left hand or counter-clockwise helical grooves, that may be keyed to the inner surface of the clutch 280. In one embodiment, the piston 260 may be keyed to the clutch 280 via one or more rolling keys 115, 125 as described above. In one embodiment, the piston 260 may be keyed to the clutch 280 via one or more corresponding splines formed on the inner surface of the clutch 280, as illustrated in FIG. 7A. The splined engagement may allow relative longitudinal movement between the piston 260 and the clutch 280, while at least partially rotationally coupling the components together.

FIG. 7A illustrates a cross-sectional view 7A-7A (shown in FIG. 5A) of the drilling tool 200. As illustrated, a clutch sleeve 214 is positioned between the clutch 280 and the housing 220, and includes one or more slots 292 that support and house one or more dogs 295. Pressurized fluid is supplied to the outer surface of the clutch sleeve 214 to bias the dogs 295 inwardly to engage one or more notches 285 disposed on the outer surface of the clutch 280, similar to the dogs 95 as shown in FIG. 4B above. The clutch sleeve 214 is fixed to the housing 220 so that no axial or rotational motion relative to the housing 220 is allowed. One or more thrust bearings 217, 219 may be disposed above and below the clutch sleeve 214 and the clutch 280 to assist with rotation. The dogs 295 and the notches 285 disposed on the outer surface of clutch 280 are arranged in such a way that the clutch 280 can rotate relative to the housing 220 in the clockwise direction (e.g. one direction) but cannot rotate in the counter-clockwise direction (e.g. reverse or opposite direction).

As the piston 260 moves in an upward direction, due to the helical grooves 261, either the piston 260 has to rotate clockwise or the clutch 280 has to rotate counter-clockwise (when looking downward as shown in FIG. 7A). During this upward motion, the dogs 295 engage in the notches 285 and prohibit the clutch 280 from rotating counter-clockwise, thereby forcing the piston's clockwise rotation. In one embodiment, if the helical grooves 261 are set at about 1.5 degrees per inch, and if the piston 260 moves up about 3 inches, then it would rotate clockwise relative to the housing 220 an angle of about 4.5 degrees.

Figure 7B:
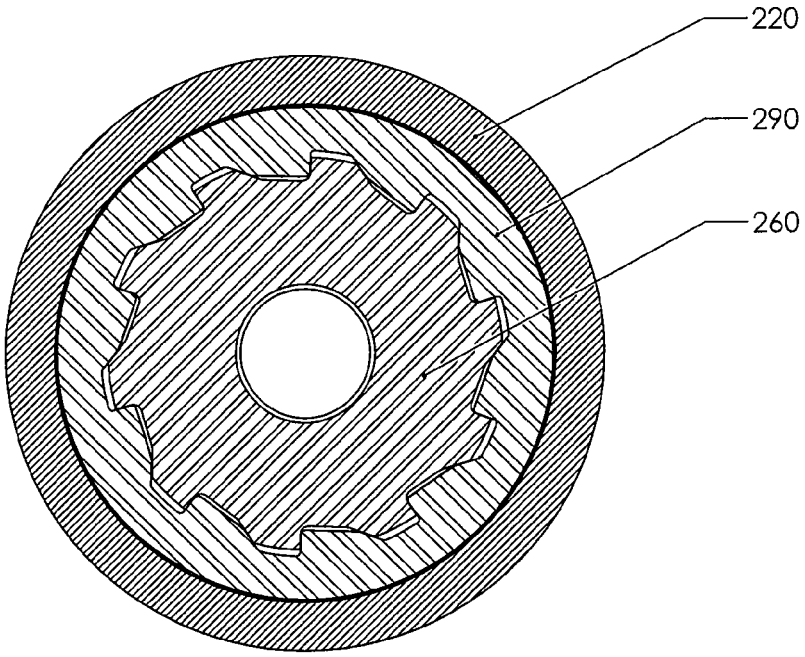

Referring back to FIG. 6, as illustrated, the lower section of the piston 260 has one or more helical grooves 262, such as right hand or clockwise helical grooves, that may be keyed to the inner surface of the drive shaft 290. In one embodiment, the piston 260 may be keyed to the drive shaft 290 via one or more rolling keys 115, 125 as described above. In one embodiment, the piston 260 may be keyed to the clutch 290 via one or more corresponding splines formed on the inner surface of the drive shaft 290, as illustrated in FIG. 7B. The splined engagement may allow relative longitudinal movement between the piston 260 and the drive shaft 290, while at least partially rotationally coupling the components together.

FIG. 7B illustrates a cross-sectional view 7B-7B (shown in FIG. 5A) of the drilling tool 200. As the piston 260 moves in an upward direction, the helical grooves 262 force the drive shaft 290 to rotate clockwise relative to the piston 260.

In one embodiment, if the helical grooves 262 on the piston 260 are set at about 1 degree per inch and the piston 260 moves upward about 3 inches, then the drive shaft 290 will rotate clockwise about 3 degrees relative to the piston 260 while the piston 260, as explained above, rotates clockwise about 4.5 degrees relative to the housing 220. Thus, the drive shaft 290 and the drill head 225 that is coupled to it are forced to rotate clockwise relative to the housing 220 an angle of about 3 degrees plus about 4.5 degrees for a total angle of about 7.5 degrees.

On the other hand, as the piston 260 moves in the downward direction, the dogs 295 slip and disengage from the notches 285 so that the clutch 280 can freely rotate in the clockwise direction any amount of angular displacement. Since the energy required to rotate the drill head 225 substantially exceeds that required to rotate the clutch 280 in the clockwise direction, the clutch 280 will rotate clockwise an angle of degrees necessary to allow the drill head 225 to remain stationary. In one embodiment, the helical grooves at the piston 260/clutch 280 areas are set at about 1.5 degrees per inch counter-clockwise, and those at the driveshaft 290/piston 260 areas are set at about 1 degree per inch clockwise. As the piston 260 moves downward 3 inches, it rotates counter-clockwise relative to the clutch 280 an angle of about 4.5 degrees. In order for the drive shaft 290 to stay stationary, the clutch 280 would need to rotate clockwise relative to the housing 220 an angle of about 7.5 degrees, effecting the rotation of the piston 260 an angle of (7.5 degrees minus 4.5 degrees) about 3 degrees clockwise relative to the housing 220. This is just enough to offset the 3 degrees counter-clockwise rotation of the drive shaft 290 relative to the piston 260. Thus, the drive shaft 290 and the drill head 225 will admit zero angular displacement as the piston 260 moves in a downward direction.

The net result is the stepping rotation of the drill head 225 in the clockwise direction. Relative rotations of different components relative to different parts are summarized in Table 1 as follows:

TABLE 1

Relative Angular Displacements

| | (1) Piston to Clutch | (2) Clutch to Housing | (3) = Sum (1), (2) Piston to Housing | (4) Drill Head to Piston | (5) = Sum (3), (4 Drill Head to Housing) |
|---|---|---|---|---|---|
| UP Stroke | CW +4.5 degrees | 0 degrees (CCW Rotation Prohibited) | CW +4.5 degrees | CW +3.0 degrees | CW +7.5 degrees |
| DOWN Stroke | CCW −4.5 degrees | CW +7.5 degrees | CW +3.0 degrees | CCW −3.0 degrees | 0 degrees |

In one embodiment, the notches 285 in the clutch 280 (in the above example) should have a resolution of about 7.5 degrees or (slightly) more to ensure that the dogs 295 will readily engage the notches 285 to prohibit the clutch 280 from counter-clockwise rotation when the piston 260 begins its next upward stroke.

Figure 8:
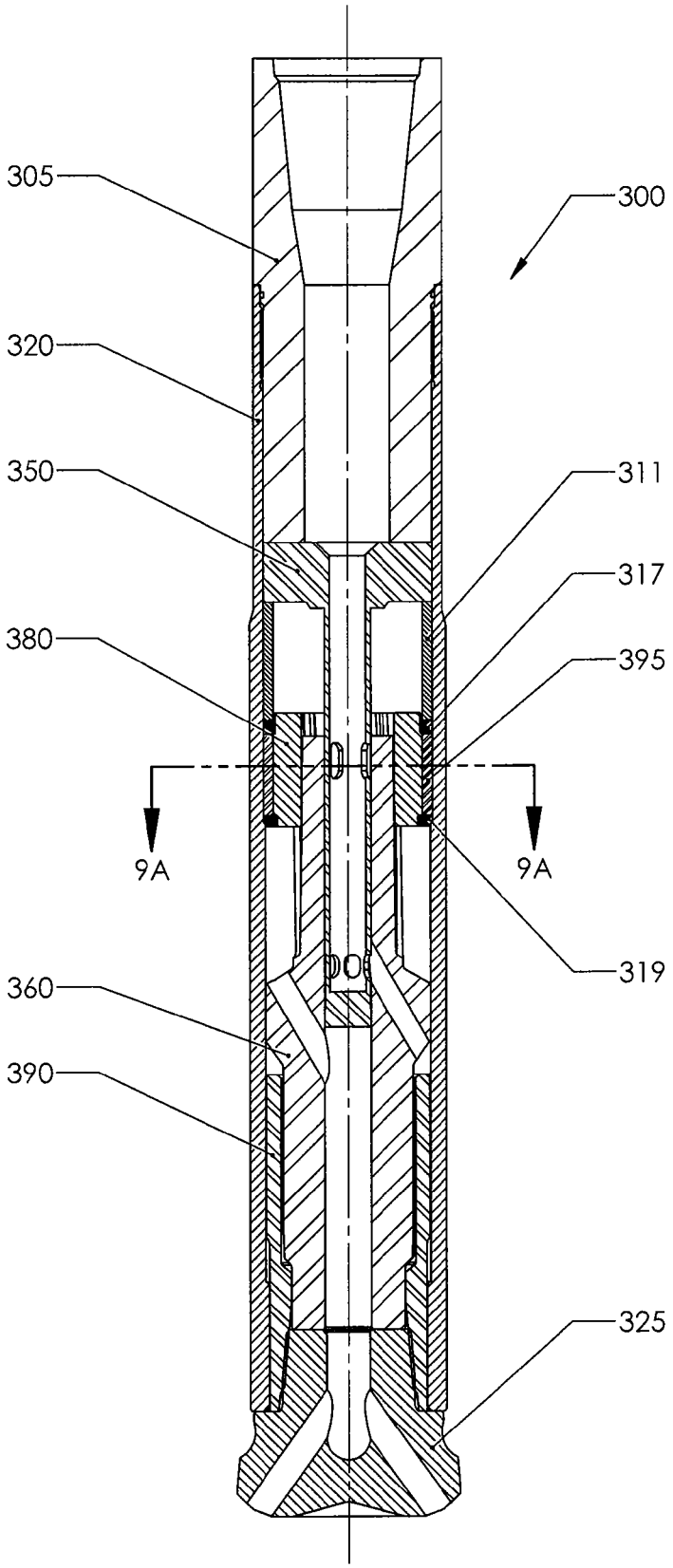
FIG. 8 illustrates a sectional view of the drilling tool according to one embodiment.

FIG. 8 illustrates a drilling tool 300 according one embodiment. The drilling tool 300 operates similar to the drilling tools 10, 200, and the embodiments of the drilling tool 300 may be used with the drilling tools 10, 200 and vice versa. Some of the components of the drilling tool 300 that are similar to the drilling tools 10, 200 are identified with a "300" series reference numeral.

Figure 9A:
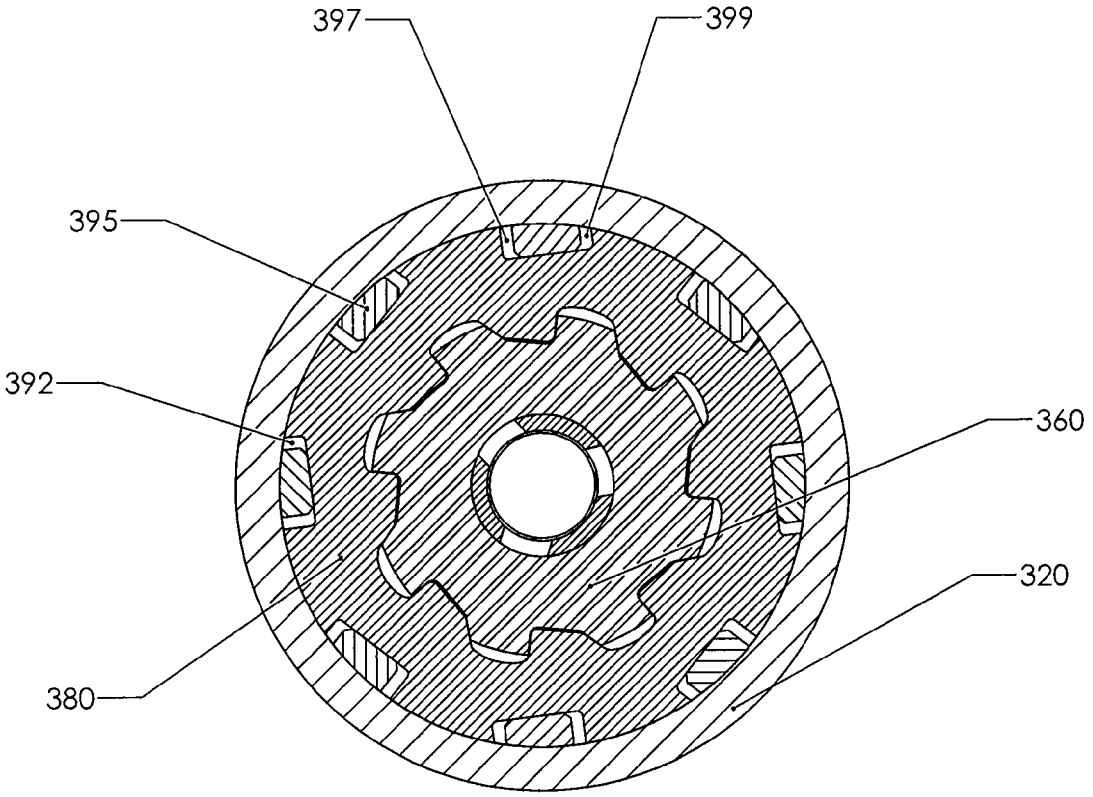
FIG. 9A illustrates a cross-sectional view of the drilling tool according to one embodiment.

The primary difference of the drilling tool 300 is the configuration of its clutch 380. The clutch 380 may operate as a one-way frictional engagement (FE) clutch, illustrated in FIG. 9A. FIG. 9A illustrates a cross-sectional view 9A-9A (shown in FIG. 8) of the drilling tool 300. FE clutches may provide an advantage over the PE clutch in that the resolution is not fixed. In an FE clutch, regardless of the degrees of rotation in one direction, the locking elements readily engage in the opposite direction thereby preventing reversed rotation. As a result, rotating the drill head 325 (as described above for example) does not depend on the length of the stroke of the piston 360 or the degrees of helical progression. The clutch 380 may include one or more wedge members 395 disposed in one or more recesses or grooves formed on the outer surface of the clutch 380. The wedge members 395 may have a longer height on one side than the other, and are positioned in one or more slots 392 formed on the outer surface of the clutch 380. A pressurized fluid, such as air, is allowed to communicate to a space 397 on the longer sides while a space 399 on the other side is communicated to low pressure. Relative to the housing 320, the wedge members 395 are thus biased toward clockwise rotation, allowing the clutch 380 to rotate clockwise; while in the reverse direction, the wedge members readily jam or wedge between the inner surface of the housing 320 and the slots 392 formed on the clutch 380 to thus prohibit the clutch 380 from rotating in the counter-clockwise direction.

In one embodiment, the clockwise and counter-clockwise rotation of the components may be reversed during the up and/or down-stroke of the pistons 60, 260, 360 of the drilling tools 10, 200, 300 described herein. In one embodiment, the grooves on the upper and/or lower section of the pistons 260, 360 may be straight, helical, and/or partially straight and partially helical in the clockwise and/or counter-clockwise direction. In one embodiment, the grooves on the upper and lower section of the pistons 260, 360 may each be arranged in the same direction or in opposite directions. In one embodiment, the pressurized fluid may include compressed air.

In one embodiment, referring back to the example cited above and as referenced in Table 1, if the helical grooves 262 on the lower section of the piston 260 are arranged in the same counter-clockwise direction as the helical grooves 262 on the upper section of the piston 260, then the UP Stroke numbers in the table would read −3 degrees in column (4), which would result in +1.5 degrees in column (5), while the DOWN Stroke numbers would read +1.5 degrees in column (2), which would result in −3 degrees in column (3), and +3 degrees in column (4), which would result in 0 degrees in column (5). Thus, the drill head 225 would rotate about 1.5 degrees clockwise per stroke of the piston 260.

In one embodiment, the drilling tools 200, 300 may include pistons that have helical grooves on the upper and lower sections of the piston arranged in the same counter-clockwise direction. The piston may also have a 3 inch stroke during operation. The upper helical grooves may be set at about 5 degrees per inch, which provides about 15 degrees of angular displacement per stroke, while the lower helical grooves may be set at about 2 degrees per inch, which provides about 6 degrees of angular displacement per stroke. The numbers for columns (1) through (5), as shown in Table 1 above, would then read +15, 0, +15, −6, +9 for the UP Stroke, and −15, +9, −6, +6, 0 for the DOWN Stroke. The result would provide a drill head rotation of (15 degrees minus 6 degrees) about 9 degrees clockwise per stroke of the piston.

While the foregoing is directed to embodiments of the invention, other and further embodiments of the invention may be devised without departing from the basic scope thereof, and the scope thereof is determined by the claims that follow.

The invention claimed is:

1. A drilling tool assembly, comprising:

a housing;

a piston disposed in the housing;

a clutch assembly coupled to the housing and the piston, wherein the clutch assembly is configured to facilitate rotation of the piston relative to the housing;

a cutting assembly coupled to the piston, wherein the cutting assembly is rotatable relative to the piston; and a drive shaft coupled to the piston and the cutting assembly, wherein the drive shaft and the piston include a splined engagement or a rolling key engagement to facilitate rotation of the cutting assembly relative to the piston.

2. The assembly of claim 1, wherein the clutch assembly includes a clutch, a clutch sleeve, and one or more dogs configured to engage an outer surface of the clutch to prevent rotation of the clutch in one direction while allowing rotation in a reverse direction.

3. The assembly of claim 1, wherein the clutch assembly includes a clutch and one or more wedge members configured to engage an inner surface of the housing to prevent rotation of the clutch in one direction while allowing rotation in a reverse direction.

4. The assembly of claim 1, wherein the piston includes an upper portion with a first set of helical grooves, and a lower portion with a second set of helical grooves, wherein the first and second sets of helical grooves are arranged in opposite directions or the same direction.

5. A drilling tool assembly, comprising:

a housing;

a piston axially movable within the housing;

a clutch assembly disposed between the housing and the piston, wherein the clutch assembly forces rotation of the piston relative to the housing while the piston moves axially within the housing in a first direction;

a drive shaft coupled to the piston; and a cutting assembly coupled to the drive shaft, wherein the cutting assembly rotates relative to the piston as the piston moves in the first direction, and wherein an inner surface of the drive shaft and an outer surface of the cutting assembly include a splined engagement or a rolling key engagement.

6. The assembly of claim 5, wherein the clutch assembly is prevented from rotating in one direction relative to the housing, thereby forcing rotation of the piston in a reverse direction as the piston moves in the first direction.

7. The assembly of claim 5, wherein the cutting assembly rotates relative to the housing in one direction as the piston moves in the first direction.

8. The assembly of claim 5, wherein the clutch assembly rotates relative to the housing while the piston moves axially within the housing in a second direction that is opposite the first direction.

9. The assembly of claim 8, wherein the cutting assembly does not rotate relative to the housing as the piston moves in the second direction.

10. The assembly of claim 5, wherein the piston includes an upper section with one or more helical grooves, and a lower section with one or more helical grooves, wherein the helical grooves on the upper section are formed in an opposite direction or the same direction relative to the helical grooves on the lower section.

11. The assembly of claim 5, wherein clutch assembly includes a clutch sleeve, a clutch, and one or more dogs disposed in one or more slots of the clutch sleeve.

12. The assembly of claim 11, wherein the one or more dogs are biased inwardly by pressurized fluid to engage one or more notches disposed on an outer surface of the clutch.

13. The assembly of claim 12, wherein an inner surface of the clutch and an outer surface of the piston include a splined engagement or a rolling key engagement.

14. The assembly of claim 5, wherein the clutch assembly includes a clutch and one or more wedge members disposed in one or more slots formed on an outer surface of the clutch.

15. The assembly of claim 14, wherein the wedge members include a first side that is longer in length than a second side, and wherein the wedge members are biased in one direction by pressurized fluid, are configured to permit rotation of the clutch in one direction, and are configured to engage an inner surface of the housing to prevent rotation of the clutch in an opposite direction.

16. The assembly of claim 5, wherein an inner surface of the drive shaft or an outer surface of the piston include helical grooves configured to rotate the cutting assembly relative to the piston.

17. A method of forming a wellbore, comprising:

positioning a drilling tool in the wellbore using a work string, the drilling tool comprising a housing, a piston, a clutch assembly, and a drill head;

reciprocating the piston axially within the housing by alternately directing pressurized fluid to an upper chamber above the piston and a lower chamber below the piston;

rotating the piston relative to the housing using the clutch assembly, wherein an inner surface of the clutch assembly and an outer surface of the piston form a splined engagement or a rolling key engagement to facilitate rotation between the clutch assembly and the piston;

rotating the drill head relative to the housing and to the piston; and applying an impact force to the drill head to form the wellbore.

18. The method of claim 17, further comprising rotating the piston in a clockwise direction as the piston moves in an upward direction away from the drill head.

19. The method of claim 17, further comprising rotating the drill head relative to the piston as the piston moves in an upward direction away from the drill head.

20. The method of claim 17, further comprising rotating the clutch assembly in a clockwise direction as the piston moves in a downward direction toward the drill head.

21. The method of claim 17, further comprising biasing one or more dogs or wedge members relative to a clutch of the clutch assembly to allow rotation of the clutch in clockwise direction and prevent rotation of the clutch in a counter-clockwise direction.

22. The method of claim 21, further comprising rotating the piston relative to the housing in a clockwise direction while preventing the clutch from rotating in the counter-clockwise direction.

23. A drilling tool assembly, comprising:

a housing;

a piston disposed in the housing;

a clutch assembly coupled to the housing and the piston, wherein the clutch assembly is configured to facilitate rotation of the piston relative to the housing, and wherein the clutch assembly includes a clutch, a clutch sleeve, and one or more dogs configured to engage an outer surface of the clutch to prevent rotation of the clutch in one direction while allowing rotation in a reverse direction; and a cutting assembly coupled to the piston, wherein the cutting assembly is rotatable relative to the piston.

24. A drilling tool assembly, comprising:

a housing;

a piston disposed in the housing, wherein the piston includes an upper portion with a first set of helical grooves, and a lower portion with a second set of helical grooves, and wherein the first and second sets of helical grooves are arranged in opposite directions or the same direction;

a clutch assembly coupled to the housing and the piston, wherein the clutch assembly is configured to facilitate rotation of the piston relative to the housing; and a cutting assembly coupled to the piston, wherein the cutting assembly is rotatable relative to the piston.

25. A drilling tool assembly, comprising:

a housing;

a piston axially movable within the housing;

a clutch assembly disposed between the housing and the piston, wherein the clutch assembly forces rotation of the piston relative to the housing while the piston moves axially within the housing in a first direction, and wherein the clutch assembly is prevented from rotating in one direction relative to the housing, thereby forcing rotation of the piston in a reverse direction as the piston moves in the first direction;

a drive shaft coupled to the piston; and a cutting assembly coupled to the drive shaft, wherein the cutting assembly rotates relative to the piston as the piston moves in the first direction.

26. A drilling tool assembly, comprising:

a housing;

a piston axially movable within the housing, wherein the piston includes an upper section with one or more helical grooves, and a lower section with one or more helical grooves, and wherein the helical grooves on the upper section are formed in an opposite direction or the same direction relative to the helical grooves on the lower section;

a clutch assembly disposed between the housing and the piston, wherein the clutch assembly forces rotation of the piston relative to the housing while the piston moves axially within the housing in a first direction;

a drive shaft coupled to the piston; and a cutting assembly coupled to the drive shaft, wherein the cutting assembly rotates relative to the piston as the piston moves in the first direction.

27. A drilling tool assembly, comprising:

a housing;

a piston axially movable within the housing;

a clutch assembly disposed between the housing and the piston, wherein the clutch assembly forces rotation of the piston relative to the housing while the piston moves axially within the housing in a first direction, and wherein clutch assembly includes a clutch sleeve, a clutch, and one or more dogs disposed in one or more slots of the clutch sleeve;

a drive shaft coupled to the piston; and a cutting assembly coupled to the drive shaft, wherein the cutting assembly rotates relative to the piston as the piston moves in the first direction.

28. The assembly of claim 27, wherein the one or more dogs are biased inwardly by pressurized fluid to engage one or more notches disposed on an outer surface of the clutch.

29. The assembly of claim 28, wherein an inner surface of the clutch and an outer surface of the piston include a splined engagement or a rolling key engagement.

30. A drilling tool assembly, comprising:

a housing;

a piston axially movable within the housing;

a clutch assembly disposed between the housing and the piston, wherein the clutch assembly forces rotation of the piston relative to the housing while the piston moves axially within the housing in a first direction, and wherein the clutch assembly includes a clutch and one or more wedge members disposed in one or more slots formed on an outer surface of the clutch;

a drive shaft coupled to the piston; and a cutting assembly coupled to the drive shaft, wherein the cutting assembly rotates relative to the piston as the piston moves in the first direction.

31. The assembly of claim 30, wherein the wedge members include a first side that is longer in length than a second side, and wherein the wedge members are biased in one direction by pressurized fluid, are configured to permit rotation of the clutch in one direction, and are configured to engage an inner surface of the housing to prevent rotation of the clutch in an opposite direction.

32. A drilling tool assembly, comprising:

a housing;

a piston axially movable within the housing;

a clutch assembly disposed between the housing and the piston, wherein the clutch assembly forces rotation of the piston relative to the housing while the piston moves axially within the housing in a first direction;

a drive shaft coupled to the piston; and a cutting assembly coupled to the drive shaft, wherein the cutting assembly rotates relative to the piston as the piston moves in the first direction, and wherein an inner surface of the drive shaft or an outer surface of the piston include helical grooves configured to rotate the cutting assembly relative to the piston.

* * * * *

UNITED STATES PATENT AND TRADEMARK OFFICE

CERTIFICATE OF CORRECTION

PATENT NO. : 8,893,823 B2
APPLICATION NO. : 12/946672
DATED : November 25, 2014
INVENTOR(S) : Bui et al.

It is certified that error appears in the above-identified patent and that said Letters Patent is hereby corrected as shown below:

Title Page, Abstract item (57):

Line 11, please insert --using-- after housing;

In the Specification:

Column 3, Line 31, please insert --using-- after housing.

Signed and Sealed this
Nineteenth Day of May, 2015

Michelle K. Lee

Michelle K. Lee
*Director of the United States Patent and Trademark Office*